United States Patent [19]

Duve et al.

[11] Patent Number: 5,042,311

[45] Date of Patent: Aug. 27, 1991

[54] SECONDARY TIMER FOR PROGRAM TIMER

[75] Inventors: John P. Duve, Brookfield; George D. Georgacakis, Skokie, both of Ill.

[73] Assignee: Eaton Corporation, Cleveland, Ohio

[21] Appl. No.: 492,258

[22] Filed: Mar. 12, 1990

Related U.S. Application Data

[63] Continuation of Ser. No. 204,941, Jun. 6, 1988, abandoned, which is a continuation-in-part of Ser. No. 37,476, Apr. 13, 1987, abandoned.

[51] Int. Cl.[5] ..... H01H 7/08

[52] U.S. Cl. ..... 74/3.5; 74/3.52; 200/38 R

[58] Field of Search ..... 74/3.5, 3.52, 3.54, 74/405, 568 T; 192/33 R; 200/35 R, 38 R, 38 BA

[56] References Cited

U.S. PATENT DOCUMENTS

| | | | |
|---|---|---|---|
| 802,323 | 10/1905 | Roewe | 74/405 |
| 2,606,476 | 8/1952 | Waller et al. | 192/33 R |
| 2,917,939 | 12/1959 | Harris | 200/38 R |
| 3,681,729 | 8/1972 | Elders | 200/38 R |
| 3,780,240 | 12/1973 | Stafford et al. | 200/38 R |
| 3,828,199 | 8/1974 | Sakai et al. | 200/38 R |
| 4,103,119 | 7/1978 | Homan et al. | 200/38 R |
| 4,503,295 | 3/1985 | Whitten | 200/38 R |
| 4,536,626 | 8/1985 | Wojtanek | 200/35 R |
| 4,577,179 | 3/1986 | Chambers et al. | 340/309.15 |
| 4,599,499 | 7/1986 | Duve | 200/35 R |
| 4,616,209 | 10/1986 | Mahon | 340/309.15 |
| 4,649,239 | 3/1987 | Duve | 200/38 R |

FOREIGN PATENT DOCUMENTS

| | | | |
|---|---|---|---|
| 1137498 | 10/1962 | Fed. Rep. of Germany | 200/38 B |
| 625141 | 6/1949 | United Kingdom | 200/35 R |
| 1468863 | 3/1977 | United Kingdom | 200/35 R |

*Primary Examiner*—Leslie A. Braun
*Assistant Examiner*—Scott Anchell
*Attorney, Agent, or Firm*—R. A. Johnston

[57] ABSTRACT

A secondary timer mechanism for controlling a secondary program function independently of a first program function. A main timer mechanism controls the first program function and is operatively driven by a motor. A second timer mechanism can be set independently of the main timer mechanism and engages the motor through a drive gear in a first axial position and is in non-engaging relation with the drive gear in a second axial position. The second timer mechanism includes a peripheral cam surface that cooperates with a cam follower to advantageously control selective electrical connection between contact portions. The contact portions regulate the secondary program function. Pins are operatively included in the second timer mechanism for maintaining an engaged relationship with the drive gear.

14 Claims, 3 Drawing Sheets

SECONDARY TIMER FOR PROGRAM TIMER

This application is a continuation, of application Ser. No. 204,941, filed 6/6/88; a continuation-in-part of Ser. No. 037,476 filed 4/13/87, now abandoned.

BACKGROUND OF THE INVENTION

This invention pertains to the art of timer mechanisms and more particularly to electromechanical timer mechanisms.

The invention is particularly applicable to actuating a switch within a program timer for a preselected duration. The secondary timer is set independently of the cycle selection of the main timer of a washing machine and will be described with particular reference thereto. However, it will be appreciated that the invention has broader applications and may be advantageously employed in a wide variety of appliances and applications.

Heretofore, timing arrangements for various household appliances have employed electromechanical timer mechanisms in an economical manner. The timer mechanisms generally utilize a cam block having plural cam tracks defined along an outer peripheral portion thereof. Cam followers are biased into abutting engagement with selected cam tracks. The cam followers are, in turn, designed to open and close electrical contact portions to provide a programmed switching action in accordance with a preselected position of the cam followers on the cam tracks. A great number of switching functions can be controlled through use of a unitary cam block. The arrangement of the cam block including its peripheral cam tracks, the cam followers, and associated switching apparatus is typically referred to as a program timer.

These program timer arrangements have met with great commercial success and are utilized in a broad cross section of appliances. Washing machines, dryers, and the like all employ timers to control various preselected programs. An operator of these appliances generally rotates the cam block to a preselected angular position corresponding to selected indicia on a control panel. For example, a ten minute permanent press cycle on a washing machine can be selected or, alternatively, a fifteen minute knit/delicate wear cycle could be chosen. Mere variation in the angular orientation of the cam block predisposes the cam tracks in a predetermined manner to open and close related electrical contact portions through the cam followers. Thus, selected angular portions of the cam block control predetermined program functions represented by the indicia on a control panel.

A drive motor rotates a cam drive which reciprocates a drive pawl. The drive pawl typically engages ratchet teeth disposed on a peripheral portion of the cam block. In this manner, the reciprocating action of the drive pawl rotates the cam block in preselected increments.

It has previously been considered unworkable to combine a secondary timing arrangement with the program timer of the cam block. Supplemental program functions can be easily accommodated on the cam block through addition of extra cam tracks and cam followers as required. These arrangements, though, are dependent on the angular starting position of the cam block and, therefore, any supplemental program functions become a part of the main program timer. Instead, an arrangement whereby the secondary timer is set and timed out. independently of the cycle selection of the main program timer is desired. Further, the secondary timer ideally would utilize the same drive mechanism that controls the main program timer without affecting its independent status.

The present invention meets the foregoing needs and others while overcoming the above-noted disadvantages in a manner that is simple, reliable, and adapted for economic use in a wide variety of applications.

SUMMARY OF THE INVENTION

In accordance with the present invention, there is provided a timer housing having a first member operatively driven by motive means for controlling a first program function. A second member is operatively driven by the same motive means and controls a second program function independently of the first member. The second member is axially movable for selective engagement and disengagement with the motive means.

According to another aspect of the invention, clutch means selectively connect and disconnect the motive means and second member.

According to a further aspect of the invention, means for biasing the second member toward one of engaged or disengaged positions is provided.

According to yet another aspect of the invention, means for selectively limiting axial movement of the second member is provided. The selective limiting means includes pins or other members adapted for selective receipt in apertures in the housing.

A principal advantage of the invention resides in the ability to set a secondary timer to control a function independently of a main timer.

Yet another advantage of the invention is found in the simplified arrangement.

A still further advantage of the invention resides in the selective engagement of the second member with the drive means.

Still other advantages and benefits of the invention will become apparent to those skilled in the art upon a reading and understanding of the following detailed description.

Brief Description of the Drawings

The invention may take physical form in certain parts and arrangements of parts, preferred and alternate embodiments of which will be described in detail in the specification and illustrated in the accompanying drawings which form a part hereof, and wherein.

DETAILED DESCRIPTION OF THE PRFERRED AND ALTERNATE EMBODIMENTS

Figure 1:
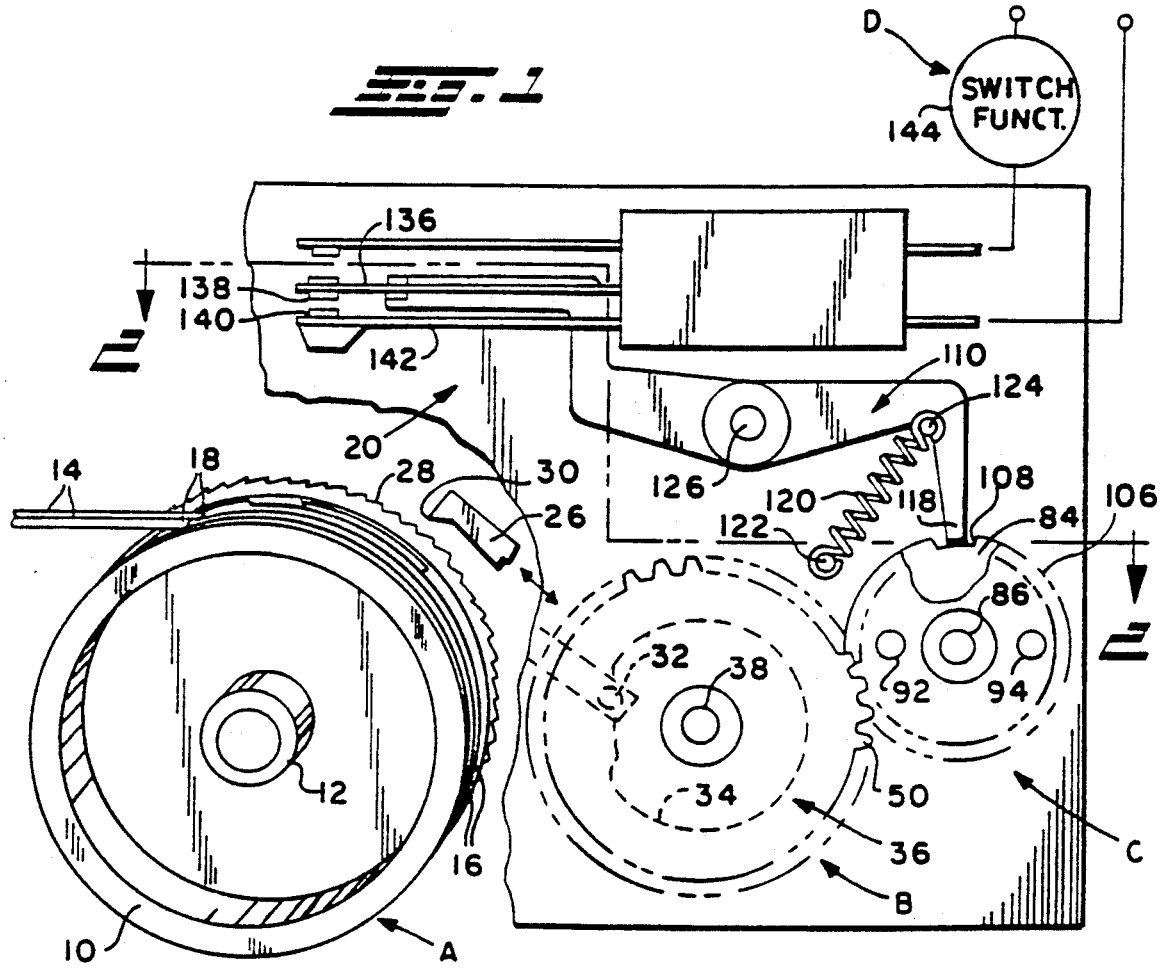
FIG. 1 is a plan view of an electromechanical timer incorporating a main timer mechanism and a secondary timer mechanism in accordance with the subject invention with selected portions shown schematically and in perspective for ease of illustration.

Referring now to the FIGS; which are for purposes of illustrating the preferred and alternative embodiments of the invention only and not for purposes of limiting same, the FIGURES show a main timer mechanism A operatively associated with a main drive means B for selectively controlling an associated main program function. A secondary timer mechanism C also operatively engages the drive means B to provide selective operation independently of the main timer. The secondary timer is designed to control an auxiliary function D.

More specifically, and in accordance with the preferred embodiment, the main timer A includes a first member or monoblock 10 designed for rotation about a hub 12 for selectively controlling associated switching members or blades 14. A peripheral portion of the monoblock includes discrete cam tracks 16 having associated peaks and valleys for varying the position of the switching blades 14. Attached to one end of the switching blade is a cam follower tip 18 which is designed to ride on the perimeter of its respective cam track 16. The blade/cam follower tip assembly is biased into operative engagement with the cam perimeter so that during rotation of the monoblock 10, the blade/cam follower tip assembly moves radially inward or outward as a result of the associated peaks and valleys on the cam track perimeter. This radial movement with respect to the hub opens and closes electrical contacts in a predetermined fashion. The electrical contacts control downstream switching operations of an associated primary program function.

As indicated above, the monoblock 10 is free to rotate about its hub 12 mounted in housing 20. Generally, the monoblock is driven by a pawl 26 that cooperates with ratchet teeth 28 disposed along the perimeter of the monoblock. The pawl includes a drive tooth 30 that engages the individual ratchet teeth 28. At an opposed end of the pawl, an axial extension 32 is received in a cam groove 34 of drive gear 36. The drive gear is adapted for rotary motion about its central hub 38 through which it is operatively engaged with motive means B, such as motor 40. The drive gear 36 includes teeth 50 arranged along the perimeter for engagement with the secondary timer mechanism C as will be described further hereinbelow. Operation of the main program timer A, specifically the motor, drive gear 36, pawl 26, and monoblock 10 and switches, is well known in the art so that further discussion is deemed unnecessary to a complete understanding of the subject invention. Further, other structural arrangements for controlling a first program function may be used without departing from the scope and intent of the subject invention.

Figure 2:
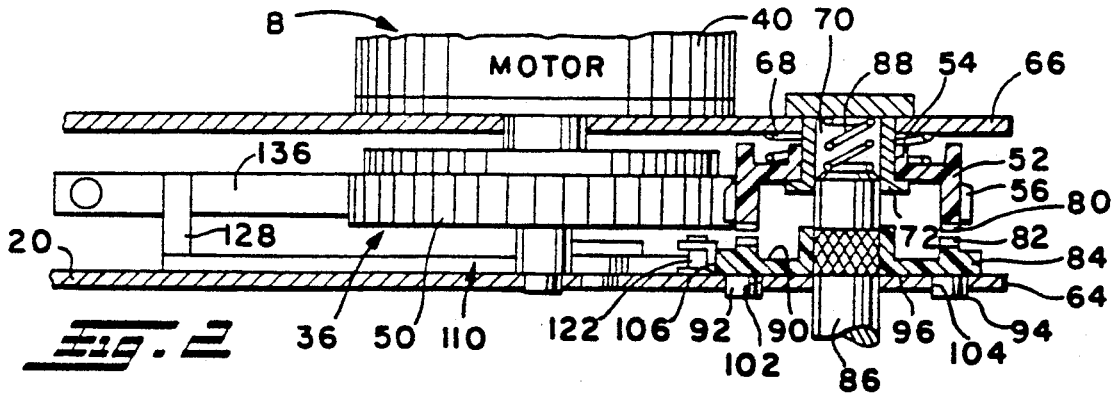
FIG. 2 is a sectional view taken generally along the lines 2—2 of FIG. 1 with selected elements of the main timer mechanism removed therefrom for ease of illustration.
Figure 3:
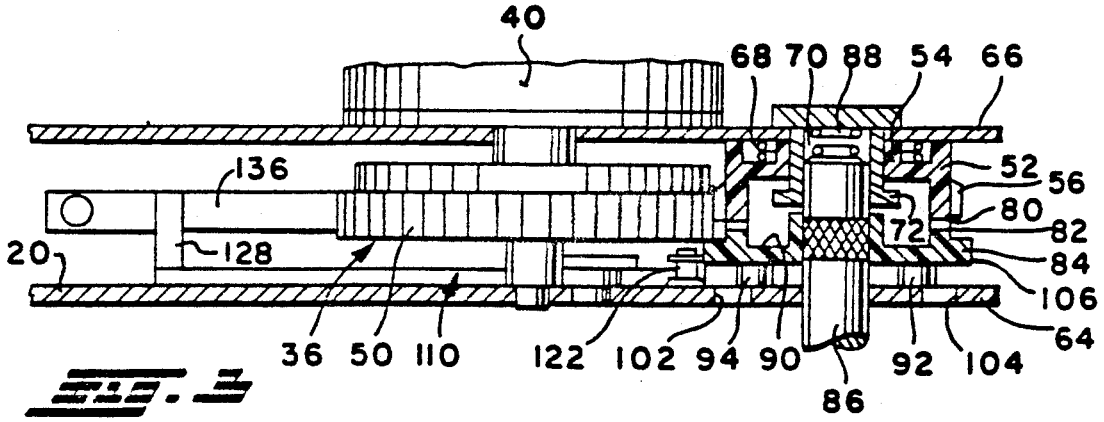
FIG. 3 is a sectional view similar to that in FIG. 2 showing the secondary timer mechanism in an actuated position.

With continued reference to the preferred embodiment of FIGS. 1-3, the secondary timer mechanism C includes a floating gear 52 having a central hub 54. The floating gear further includes peripheral teeth 56 that continually engage the peripheral teeth 50 of the drive gear. In this manner, the floating gear is always driven whenever the drive gear is actuated. As illustrated in FIG. 1, counterclockwise movement of the drive gear imparts clockwise movement to the floating gear 52.

In the embodiment illustrated, the drive gear and floating gear are axially positioned between a first or front wall 64 and a second or rear wall 66 (FIG. 2) of the housing 20. The floating gear 52 is biased away from the second wall 66 through use of a first compression spring 68. The floating gear is received over central bushing 70 that, in turn, has an enlarged radial portion 72 axially spaced from the second wall 66. The enlarged radially extending portion 72 defines a stop limit for axial movement of the floating gear 52 from the rear wall 66 toward the first wall 64.

The floating gear 52 further includes a one-way clutch means. Preferably, the one-way clutch means comprises a serrated portion 80 on a first face of the floating gear disposed in facing relation with the first wall 64. The serrated portion 80 is designed for selective, operative engagement with a similarly serrated portion 82 on secondary time setter 84. The secondary time setter 84 is secured to a shaft 86 for non-rotative relation therewith. The shaft and secondary time setter are biased toward the first wall 64 by a second compression spring 88. The second spring 88 is generally concentrically positioned relative to the first spring 68. Further, the second spring 88 biases the secondary time setter to a non-engaging, spaced relationship with floating gear 52 (FIG. 2). As shown, the serrated portion 82 is disposed on a first face 90 of the secondary time setter. First and second pins or dogs 92, 94 extend outwardly from an opposed, second face 96 of the secondary time setter.

In a non-engaging position of the secondary time setter, the pins 92, 94 are closely received in respective recesses or apertures 102, 104 formed in the first wall 64 (FIG. 2). The pins are fully received in their respective apertures so that the shaft and secondary time setter are fixed against rotation. The pins are preferably mounted at different radial distances from the shaft so that each pin can correspondingly be received only in its respective aperture. In other words, pin 92 is disposed at a first radial dimension from the shaft whereas pin 94 is disposed at a different, second radial dimension. Upon rotation of the secondary time setter 84 from its non-engaging position, the pins would only be received in their respective apertures at a single angular position, i.e. after a 360° rotation.

To rotate and set the secondary time setter 84, the shaft 86 and time setter are moved axially from their non-engaging position of FIG. 2 toward the second wall 66. The facing, serrated portions 80, 82 are brought into abutting engagement (FIG. 3). The serrated portions permit rotation of the shaft and time setter in one direction only, i.e. in a clockwise motion when viewed as illustrated in FIG. 1. The opposed serrated portions slide over one another as the secondary time setter is rotated in this direction. Any attempt to rotate the time setter in the opposite direction (counterclockwise) interlocks the time setter against the floating gear which is fixed against rotation by the drive gear and motor. The secondary time setter may be positioned at any desired angular position through continued rotation in the one direction (clockwise).

Once the secondary time setter is positioned at a preselected angular orientation, the pins 92, 94 maintain the secondary time setter in operative engagement with floating gear 52. The pins abut an inner face of first wall 64 when they are not aligned with their respective apertures. Thus, spring 88 remains under compression as the secondary time setter is limited against axial movement in the engaged position of FIG. 3.

As is apparent in FIGS. 2 and 3, the floating gear 52 is adapted for limited axial movement relative to central bushing 70. Axial advancement of the secondary time setter to an engaged position axially moves the floating gear toward the second wall 66, thus slightly compressing spring 68. Further, rotation of the secondary time setter in a clockwise direction as shown permits the serrated portions 80, 82 to slide over one another with minute axial movement of the floating gear. Nevertheless, the floating gear maintains engagement with the peripheral teeth 50 of the drive gear during axial movement.

The secondary time setter 84 further includes a cam means or track 106 along an outer peripheral portion thereof. The cam track includes a radially recessed area 108. A lever 110, specifically lever first end 118, engages the cam track portion and pivots accordingly. The lever first end 118 is designed for continual, abutting engagement with the peripheral cam track portion 106 due to the biasing force imposed by spring 120. The spring 120 is interposed between a fixed spring post 122 and an extension flange 124 on the lever. Since the spring post is fixed to the housing 64 (FIG. 2), and the spring placed under tension, the lever is continually biased into engagement with the peripheral cam track portion 106.

The lever rotates around pivot point 126, which is preferably a pin connection mounting of the lever with the housing. An opposed end of the lever includes a blade depressor portion 128. The depressor portion 128 is adapted for selective abutting engagement with switching blade 136. The blade has an electrical contact 138 disposed at an outer end thereof adapted to operatively engage a similar electrical contact 140 disposed on an outer end of a stationary blade 142. Electrical connection between contacts 138, 140 may be designed to control any of a number of various functions. According to the preferred embodiment, an associated fill valve 144 is controlled through selective regulation of the electrical contacts 138, 140.

By way of example only, positioning of the lever first end 118 in the recessed area 108 of the secondary time setter biases the blade depressor portion 128 into operative engagement with blade 136. In this position, the electrical contacts 138, 140 are separated and electrical power is cut off to the switching functions 144. Upon depression of the shaft 86 and rotation of the secondary time setter 84, the peripheral cam track portion 106 pushes the lever first end 118 radially outward against the bias of spring 120. In turn, the depressor portion 128 is moved downwardly as shown in FIG. 1 so that electrical connection is established between contacts 138, 140. Power is thereby supplied to the switching functions 144 as the drive gear drivingly rotates the secondary time setter.

Power will continue to be supplied to the switching functions until rotation of the secondary time setter is angularly oriented to the position illustrated in FIG. 1. At this point, the recessed area 108 receives the lever first end 118 which pivots lever 110 so that power is shut off to the switching functions. Also, the pins 92, 94 are aligned with their respective apertures in this position and the secondary time setter is biased axially to its non-engaging position of FIG. 2. The motor 40 continues to drive the drive gear 36 which actuates movement of the monoblock 10 and the floating gear wheel 52. Thus, the first program function continues independently of the secondary timer mechanism.

Figure 4:
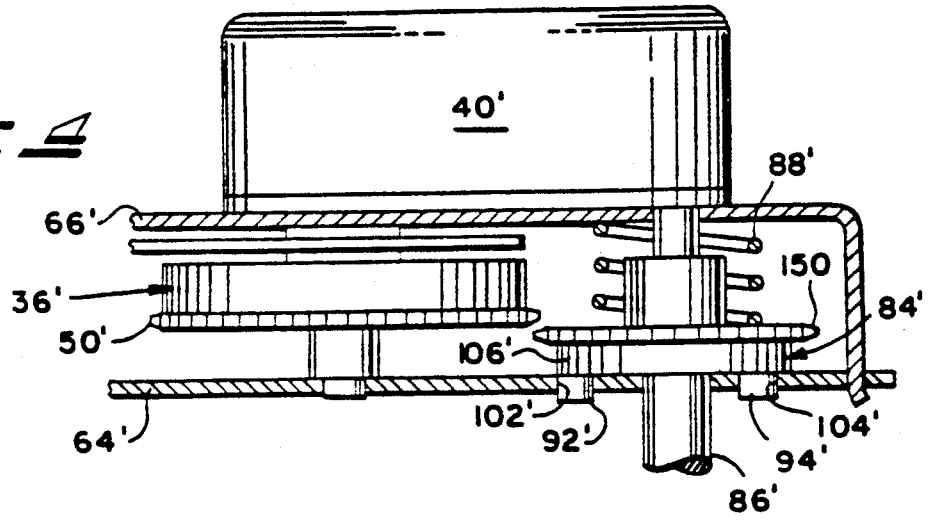
FIG. 4 illustrates an alternative, secondary timer mechanism in a non-engaging, deactuated position.
Figure 5:
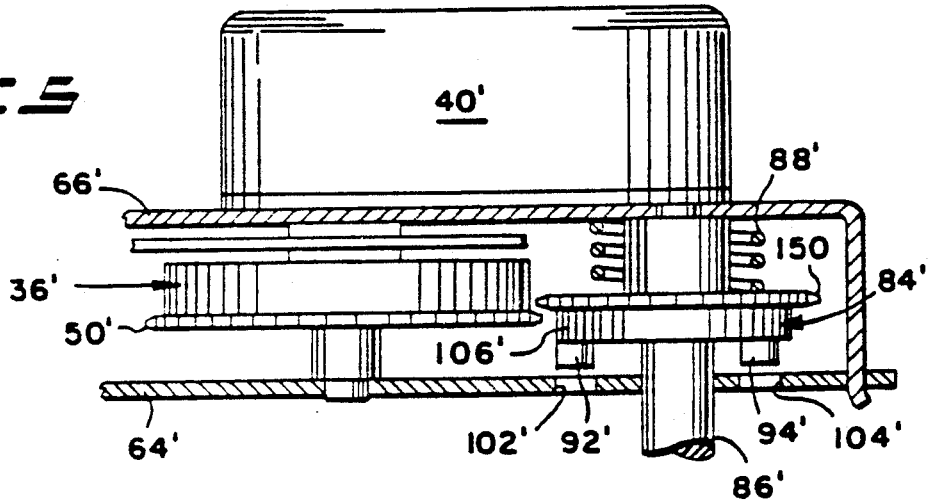
FIG. 5 is a view similar to that of FIG. 4 illustrating the orientation of the secondary timer mechanism elements during a non-engaging, setting mode; and, FIG. 6 is a view similar to that of FIG. 4 where the elements of the secondary timer mechanism are in an engaged position.
Figure 6:
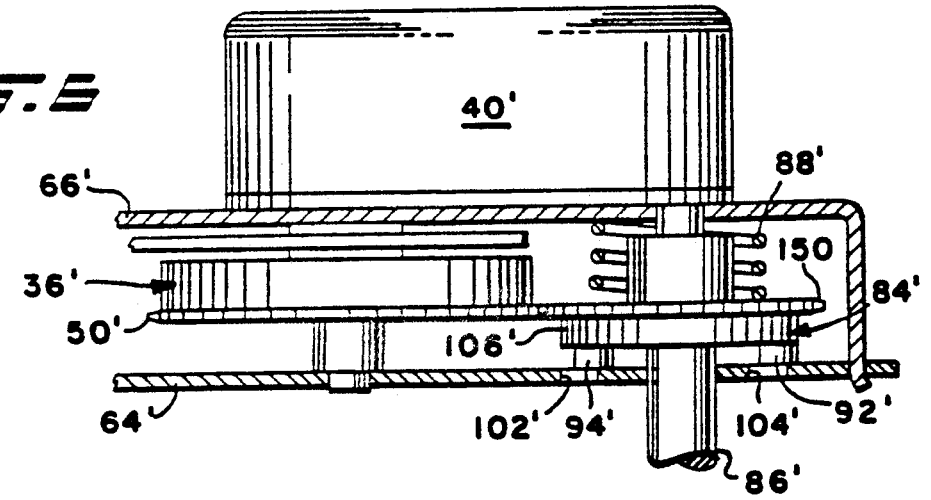

Turning now to the alternative embodiment of FIGS. 4–6 and for ease of illustration, like elements are identified by like numerals with a primed (') suffix and new elements are identified by new numerals. A motor 40' provides a continual rotary motion to drive gear 36'. The peripheral teeth 50' of the drive gear are dimensioned for selective engagement with the secondary time setter 84'. A shaft 86' is secured to the secondary time setter and may be molded as an integral piece thereof.

The secondary time setter includes pins 92' and 94' adapted for cooperative engagement with apertures 102', 104'. A peripheral cam track portion 106' also includes a recessed area (not shown) defined on the time setter and adapted to receive the lever first end (not shown) in a manner similar to the embodiment of FIGS. 1–3. A set of peripheral teeth 150 are designed for selective engagement with teeth 50' of the drive gear.

As shown in FIG. 4, the secondary time setter is in a deactuated position in which pins 92' and 94' are received in apertures 102', 104'. The secondary time setter is biased toward the first wall 64' by compression spring 88'. To set the secondary time setter 84', an actuating force is applied to the shaft 86' to overcome the biasing force of spring 88'. The peripheral teeth 150 slide axially past the teeth 50' of the drive gear (FIG. 5). The pins 92' and 94' are completely removed from apertures 102', 104' so that rotation of the secondary time setter is possible. A preselected angular orientation of the time setter positions the pins 92', 94' away from the apertures 102', 104'.

Removal of the axial actuating force on the shaft 86' allows the biasing force of the spring 88' to push the secondary time setter toward the first wall 64'. The pins 92', 94' limit the axial movement of the secondary time setter toward the first wall 64'. The biasing force of spring 88' positions the secondary time setter at an intermediate location (FIG. 6) so that peripheral teeth 150 are drivingly engaged by teeth 50' of the drive gear. Continued rotation of the drive gear times out the secondary time setter to a position such that pins 92', 94 are re-oriented with their apertures 102', 104'. The spring 88' continues to apply a biasing force toward the first wall 64' so that the secondary time setter's initial disengaged position as illustrated in FIG. 4 is obtained. The drive gear continues to rotate and actuate the first program function irrespective of the secondary time setter 84'.

Figure 7:
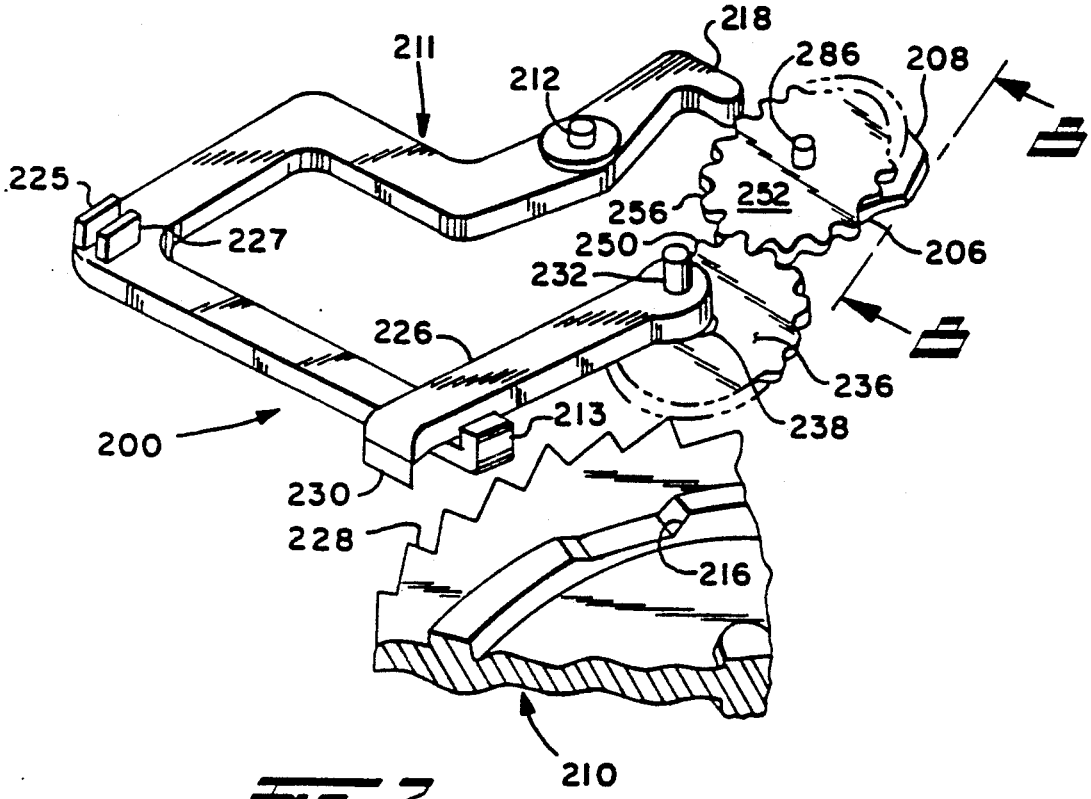
FIG. 7 is a somewhat perspective view of an alternate embodiment of the invention, wherein the secondary timer mechanism disables the ratchet advance pawl for providing a selected delay.

Referring to FIG. 7, the secondary timer mechanism is indicated generally at 200 and has a main program cam or monoblock 210 which has a cam track 216 provided thereon for providing the main program switching functions. It will be understood that the main program switches have been omitted in FIG. 7 for simplicity.

The monoblock 210 has a plurality of ratchet teeth 228 provided thereon and the monoblock is advanced by an oscillating pawl 226 having a chisel portion 230 which engages the ratchet 228. The pawl is oscillated by an eccentrically mounted pin 232 which extends axially from a motor driven drive gear 236 which rotates about the driven shaft 238 which is connected to a motor drive (not shown), but which may be similar to the motor 40 described with respect to the embodiments of FIGS. 1, 2 and 3.

Figure 8:
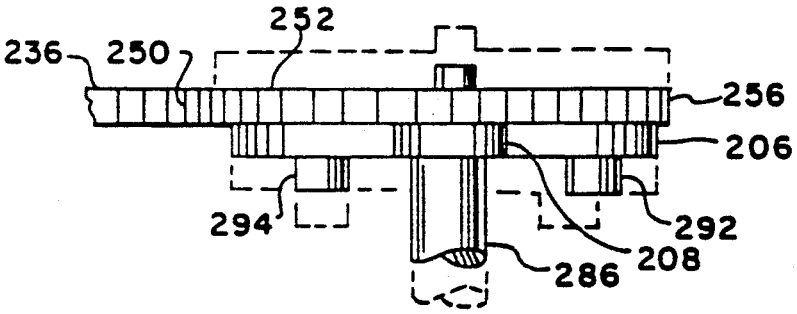
FIG. 8 is a section view taken along section-indicating lines 8—8 of FIG. 7.

Referring to FIGS. 7 and 8, a secondary timer driven gear 252 has the teeth 256 thereof meshing with teeth 250 of the gear 236 and the gear 252 rotates about the shaft 286. Gear 252 has attached thereto on the axially underface thereof and for rotation therewith a secondary timer cam track 206 which has a lobe 208 provided thereon and which extends for a minor fraction of the circumference thereof. With reference to FIG. 8, it will be understood that the shaft 286 is received in an aperture in the timer housing in the same manner as the embodiment of FIGS. 4–6 and is biased in a downward direction by a spring similar to the spring 88' (not shown in FIG. 8). The shaft 286 is movable axially to three positions in the same manner as the shaft 86' in FIGS. 4–6. In the illustration of FIGS. 7 and 8, the gear 252 is shown in solid outline as meshed with drive gear teeth 250 analogous to the position of the gear 150 in FIG. 6, and gear 252 has a pair of pins or legs 292, 294, which are similar to the pins 94', 92' in FIG. 6, and which are adapted to be received in corresponding holes provided in the housing. The alignment of the pins 294, 292 is generally at 90° to the center of the cam lobe 208 such that the pins 294, 292 drop into the holes provided in the housing when the cam lobe 208 is shown is in a position 180° opposite that shown in FIG. 7. The downward axially position of the shaft 286 is shown in dashed outline in FIG. 8. This downward position represents the condition of time-out of the interval for the cam track 206 and this downward position disengages the teeth 256 from the teeth 250 of the gear 236.

Referring to FIG. 8, the upward axially position corresponding to the SET position for the secondary cam 206 is shown in dashed outline and corresponds to the position shown for gear 150 in the embodiment of FIG. 5; and, in this upward position, enables the shaft 286 to be rotated to selectively position the cam lobe 208 for the desired interval of time-out as determined by the fraction of a full revolution of the gear 252 reserved before the lobe 208 is in the desired position.

With continued reference to FIG. 7, a cam follower lever 211 is provided and is pivotally mounted about shaft 212. The cam follower 211 has a portion 218 which rides on the cam tract 206. A lever 211 has a lug or tab 213 provided on the end thereof which engages the underside of pawl 226 and as shown in solid outline in FIG. 7, lifts the pawl from engagement with ratchet teeth 228 when the end 218 is in contact with the cam track 206. It will be understood that when the lobe 208 raises the end 218 of the cam follower, the cam follower 211 is pivoted about shaft 212 to move to the position such that the end 213 is in the position shown in dashed outline in FIG. 7. With the end 213 of the cam follower 211 positioned as shown in dashed outline in FIG. 7, the chisel tip 230 of pawl 226 is permitted to engage the teeth 228 of the ratchet to enable the pawl for advancement of the monoblock 210. Thus, it will be understood that the selected position of the cam 206 such that the lobe 208 is located circumferentially in predetermined fraction of the revolution of cam 206 provides a period of dwell wherein the end 218 of the lever 211 rides against the lower part of cam 206 causing the pawl tip 230 to be disengaged from the ratchet teeth 228 until the lobe 208 raises the tip 218 of lever 211 to permit the pawl to engage the ratchet 228 for advancement of the monoblock. In this manner, a preselected auxiliary or sub-interval may be chosen to delay the commencement of the program for the purpose of performing other functions. It will be understood that the embodiment of FIGS. 7 and 8 may also combine the delay function with that of switching an auxiliary set of contacts such as contacts 138, 140 shown in FIG. 1 by virtue of the lugs 225, 227 provided on the lever 211.

The embodiments of FIGS. 7 and 8 thus provides a unique and novel secondary timer mechanism for a program timer driven by a single timing motor, wherein the user may select a auxiliary or sub-interval program for performing an auxiliary function of providing an initial desired delay in the main program.

The invention has been described with reference to the preferred and alternate embodiments. Obviously, modifications and alterations will occur to others upon a reading and understanding of the specification. It is intended to include all such modifications and alterations insofar as they come within the scope of the appended claims or the equivalents thereof.

Having thus described the invention, it is now claimed:

1. A secondary timer assembly for controlling a secondary program function comprising:

a main timer mechanism including a first member selectively positionable for control of an associated first program function;

a secondary timer mechanism including a second member selectively rotatably user positionable independently of said main timer first member for control of an associated secondary program function;

common motive means for driving said main and second timer mechanisms and upon user movement of said second member of said secondary timer mechanism upon user movement to a first axial position said second member effects driving engagement of said second timer mechanism and thereafter upon rotary movement of said second member by said common motive means to a predetermined position, said second member automatically effects disengagement of said common motive means from said second timer mechanism.

2. The secondary timer assembly defined in claim 1 further including one-way clutch means for effecting said driving engagement of said second timer mechanism.

3. The secondary timer assembly defined in claim 1 further comprising means for biasing said second timer member away from said first axial position.

4. The secondary timer assembly defined in claim 1 further comprising means for limiting axial movement of said second member.

5. The secondary timer assembly defined in claim 1 wherein said second timer member includes a cam means having drive teeth disposed around a peripheral portion thereof, said drive teeth driven by said common motive means in said first axial position.

6. The secondary timer as defined in claim 1 wherein said second member includes pin means operable to engage a recess in said housing for limiting rotational movement of said second member.

7. The secondary timer as defined in claim 1, wherein said second member automatically moves to a second axial position for effecting said disengagement.

8. The secondary timer as defined in claim 1, wherein said second timer mechanism includes a third member associated with said second member and operable, when said second member is rotated to said predetermined position, to disengage said common motive means from said first timer mechanism.

9. A programmer timer of the type having a rotary main program cam advanced through a program interval for effecting actuation of at least one switch, said assembly comprising:

(a) drive means having a single drive motor and operable, upon energization, to effect advancement of said main program cam for said program interval;

(b) secondary cam means operable for rotary advancement upon connection to said drive means to provide a secondary program interval;

(c) cam follower means operable to follow said secondary cam means and perform a secondary function;

(d) rotatable selector means operable, upon user axial movement to a first position to thereupon be selectively user rotated to position said secondary cam means for setting the desired length of said secondary program interval; and, (e) engagement means operable to drivingly connect said secondary cam means to said drive means such that said secondary program interval commences simultaneously with commencement of said selected main program interval thereby causing said secondary function to be performed during an initial portion of said main program, said engagement means including means operable to automatically disengage said secondary cam means from said drive means upon termination of said secondary program interval.

10. The programmer timer defined in claim 9, wherein said engagement means includes one-way clutch means interconnecting said secondary selector means and said drive means.

11. The programmer timer defined in claim 9, wherein said rotatable selector means is operable to move automatically to a second axial position for automatically disengaging said drive means.

12. The programmer timer defined in claim 9, wherein said cam follower means includes means operable to disengage said drive means from said main program cam upon termination of said secondary program interval.

13. The programmer timer defined in claim 9, wherein:

(a) said drive means includes drive pawl means engaging a ratchet on said program cam; and, (b) said cam follower means includes lever means operable to prevent said pawl means from engaging said ratchet upon termination of said secondary program interval.

14. The programmer timer defined in claim 9, wherein said engagement means includes a gear wheel and pin means, said pin means operable to engage a recess to permit said gear wheel to move axially to disengage said drive means from said secondary cam means.

* * * * *

UNITED STATES PATENT AND TRADEMARK OFFICE

CERTIFICATE OF CORRECTION

PATENT NO. : 5,042,311

DATED : August 27, 1991

INVENTOR(S) : J. P. Duve, et al.

It is certified that error appears in the above-identified patent and that said Letters Patent is hereby corrected as shown below:

Column 8, line 35, delete "upon user movement".

Signed and Sealed this

Twelfth Day of October, 1993

*Attest:*

*Attesting Officer*

Bruce Lehman

BRUCE LEHMAN

*Commissioner of Patents and Trademarks*